US008057644B2

(12) United States Patent
Toth et al.

(10) Patent No.: US 8,057,644 B2
(45) Date of Patent: Nov. 15, 2011

(54) PROCESS AND APPARATUS FOR PLATING ARTICLES

(75) Inventors: James R. Toth, Ann Arbor, MI (US); Miguel Azevedo, Ann Arbor, MI (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 702 days.

(21) Appl. No.: 12/092,185

(22) PCT Filed: Jul. 26, 2006

(86) PCT No.: PCT/US2006/029072

§ 371 (c)(1),
(2), (4) Date: Oct. 13, 2008

(87) PCT Pub. No.: WO2008/013535

PCT Pub. Date: Jan. 31, 2008

(65) Prior Publication Data

US 2009/0301892 A1 Dec. 10, 2009

Related U.S. Application Data

(60) Provisional application No. 60/702,483, filed on Jul. 26, 2005.

(51) Int. Cl.
*C25D 17/00* (2006.01)

(52) U.S. Cl. ..... 204/199; 204/218

(58) Field of Classification Search ..... 204/199, 204/212, 218; 205/137
See application file for complete search history.

(56) References Cited

U.S. PATENT DOCUMENTS

| | | | | |
|---|---|---|---|---|
| 2,048,578 | A * | 7/1936 | van der Horst | 205/131 |
| 3,036,967 | A | 5/1962 | Lapham | |
| 4,529,668 | A | 7/1985 | Croopnick et al. | |
| 4,664,021 | A | 5/1987 | Ruddy | |
| 5,450,784 | A * | 9/1995 | Shureb | 92/223 |
| 5,534,126 | A | 7/1996 | Stadler et al. | |
| 5,750,014 | A | 5/1998 | Stadler et al. | |
| 6,126,808 | A | 10/2000 | Rasmussen | |
| 6,254,759 | B1 | 7/2001 | Rasmussen | |
| 6,561,322 | B2 | 5/2003 | Kurita et al. | |
| 6,562,223 | B2 | 5/2003 | Rasmussen | |
| 6,814,851 | B2 | 11/2004 | Sasaki et al. | |
| 6,821,408 | B2 | 11/2004 | Sasaki et al. | |
| 7,060,176 | B2 | 6/2006 | Rasmussen | |
| 2005/0056541 | A1 | 3/2005 | Oikawa et al. | |
| 2006/0113193 | A1 | 6/2006 | Rasmussen | |

FOREIGN PATENT DOCUMENTS

DE 3636532 5/1987

(Continued)

*Primary Examiner* — Luan Van

(74) *Attorney, Agent, or Firm* — Robert L. Stearns; Dickinson Wright, PLLC

(57) ABSTRACT

A process and apparatus utilizing at least one conformable anode (40) in a plating process to apply a plating to an article (10). A wire or other material suitable for an anode is shaped to conform to the approximate shape of a region of the article to be coated. The anode is powered by an electrical power source (44), and the article serves as the cathode. The anode and article are both immersed in a plating bath (38). The article and anode are rotated relative to one another about a central axis (22) of the article. The relative movement between the anode and the article causes a uniform plating (46) to be applied to selected regions of the article that pass the anode. Another anode (50) can be arranged in fixed relation with the article to cause plating to a separate selected region of the article concurrently with the other anode.

6 Claims, 3 Drawing Sheets

FOREIGN PATENT DOCUMENTS

| | | | |
|---|---|---|---|
| GB | 2246791 | | 2/1992 |
| JP | 5326740 | | 3/1978 |
| JP | 01201498 | A | 8/1989 |
| JP | 499298 | | 3/1992 |
| JP | 04099296 | A | 3/1992 |
| JP | 04224695 | A | 8/1992 |
| JP | 09003688 | A | 1/1997 |
| JP | 200045093 | | 2/2000 |

* cited by examiner

PROCESS AND APPARATUS FOR PLATING ARTICLES

This application claims the benefit of U.S. Provisional Application Ser. No. 60/702,483, filed Jul. 26, 2005, which is incorporated herein in its entirety.

BACKGROUND OF THE INVENTION

1. Technical Field

This invention relates generally to processes and apparatus for plating articles, such as, but not limited to, pistons for combustion engines.

2. Related Art

It is known to plate articles by immersing an article in a plating bath and establishing an anode/cathode arrangement whereby one or more surfaces of the article are plated with material from the bath solution. For example, some articles are plated with chrome using this general technique.

One of the challenges presented in plating articles having contoured surfaces and/or sharp corners is that the shape of the article can interfere with the uniform development of the coating, with some areas getting more coating than is otherwise desired and others getting less than what is otherwise desired.

SUMMARY OF THE INVENTION

The present invention provides an apparatus and process for plating articles with a coating from a plating bath, such as, for example, application of a chrome-based coating to surfaces of a piston. The apparatus includes a shaped anode which is contoured to at least some of the outer contoured features of the article. The article itself is made the cathode, and the cathode and anode are moved relative to one another during plating to control application of the plating to the article.

According to a particular embodiment, the shaped anode is held stationary and the piston is rotated in the plating bath relative to the shaped anode. This relative movement, and particularly the relative rotational movement enables better control of the application of the coating to desired areas of the piston in need of the coating. In this regard, the invention is particularly well suited to articles having rotational symmetry such that the shape of the anode can be fixed and the article rotated relative to the anode to maintain a constant spacing between the article and contours of the anode during plating. In this regard, pistons are particularly well suited in that many of the features, including the outer surface of the piston, the ring grooves, the top surface, and often the combustion bowl, have symmetry relative to a central longitudinal axis of the piston body, or at least approximate symmetry.

In regard to coating a piston, not only is there is an advantage to coating the outer surface, but also coating the surface of the upper ring groove, the top face, as well as the combustion bowl. In some piston configurations, the combustion bowl has a reentrant bowl configuration such that the combustion bowl undercuts a circumferential upper lip of the bowl, thus, making it particularly difficult to plate these areas using a conventional plating bath arrangement. The present invention can accommodate such difficult contours, by extending, in the case of the upper ring groove, a portion of the anode into the ring groove and shaping the anode across the top surface and into the combustion bowl and to include, if necessary, the reentrant feature of the combustion bowl. As such, the desired amount of coating is applied, as desired, to the surfaces during the plating process as the piston rotates relative to the anode about the longitudinal axis of the piston in order to enable a uniform deposition of the plating material in the desired areas associated with the shaped anode.

According to a further particular feature of the invention, the apparatus and process may optionally include at least a second anode that is stationary relative to the article being plated and moveable relative to the first anode. In one preferred arrangement, this second anode is designed to rotate with the article relative to the first anode for simultaneously plating other areas of the article which may not be accessible or convenient for access by the first fixed anode. For example, the article may have internal features or passages that are not accessible from outside the article (for example, passages or bores or non-circular features). In the case of a piston, it may, for example, be desirable to plate the pin bores from the plating bath. A pin-shaped anode may be positioned in the pin bores and supported for rotation with the piston about the longitudinal axis of the piston and coupled to an associated rectifier to impart controlled plating to the surfaces of the pin bores. This may be done at the same time that the outer surface of the piston is being plated as it rotates relative to the rotationally fixed first anode. With this apparatus and method, it makes it possible to coat the piston skirt, top ring groove and combustion bowl of the piston via the first anode while also plating the pin bores via the second anode in the same plating bath and at the same time so as to achieve the desired consistency and uniformity of plating on all the desired surfaces in a single step process.

BRIEF DESCRIPTION OF THE DRAWINGS

These and other features and advantages of the present invention will become more readily appreciated when considered in connection with the following detailed description of presently preferred embodiments and best mode, appended claims and accompanying drawings, wherein:

DETAILED DESCRIPTION OF PREFERRED EMBODIMENTS

The invention provides a process and apparatus that utilizes conformable anodes in a plating process to apply a plating material to an article. A wire or other material suitable for an anode is shaped to conform to the approximate shape of a region of the article to be coated. The anode is powered by an electrical power source, such as a rectifier, and the article serves as the cathode, wherein the anode and article are both immersed in a plating bath. While immersed, there is relative movement imparted between the anode and the article. In one presently preferred embodiment, the article is rotated relative to the anode about a central axis of the article, wherein the anode can be fixed so as to not rotate about the central axis. As a result of the relative movement between the anode and the article, a uniform plating is applied to the regions of the article that pass by the anode, thereby achieving, if desired, a 360 degree plating of the article.

The method and apparatus may also include one or more additional anodes that may be positionally fixed relative to the article (and thus relatively moveable relative to the other shaped anode to plate other areas of the article that are inaccessible or less conventionally coated by the other shaped anode). For example, if the article has a bore that is arranged transverse to the rotation axis of the article, the apparatus and method contemplates inserting a correspondingly shaped anode into the bore that can rotate with the article such that the surfaces of the bore can be plated in the same bath and at the same time as the other surfaces being plated in connection with the shaped anode.

Figure 1:
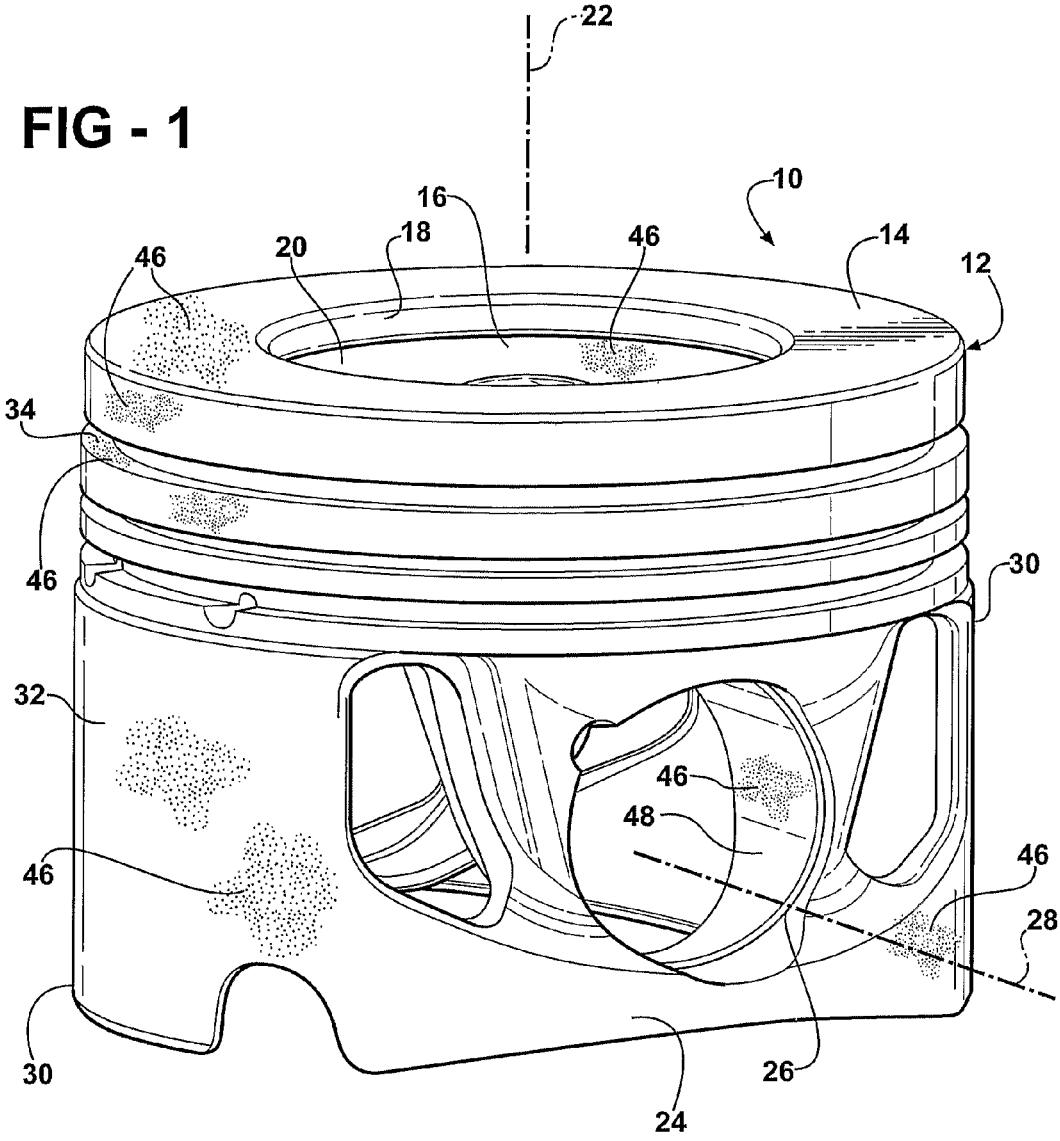
FIG. 1 is a perspective view of an article plated by the process.
Figure 2:
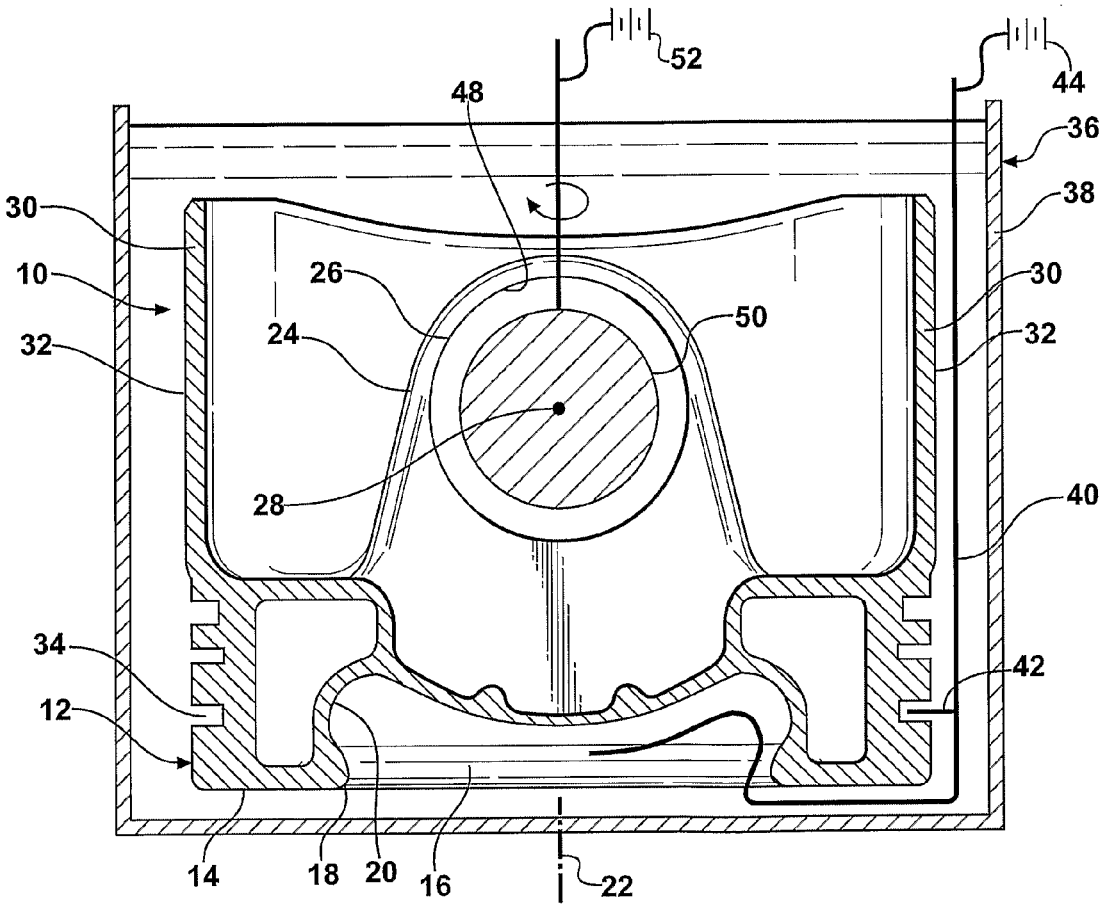
FIG. 2 is a schematic cross-sectional view of the article shown in association with the plating apparatus.
Figure 3:
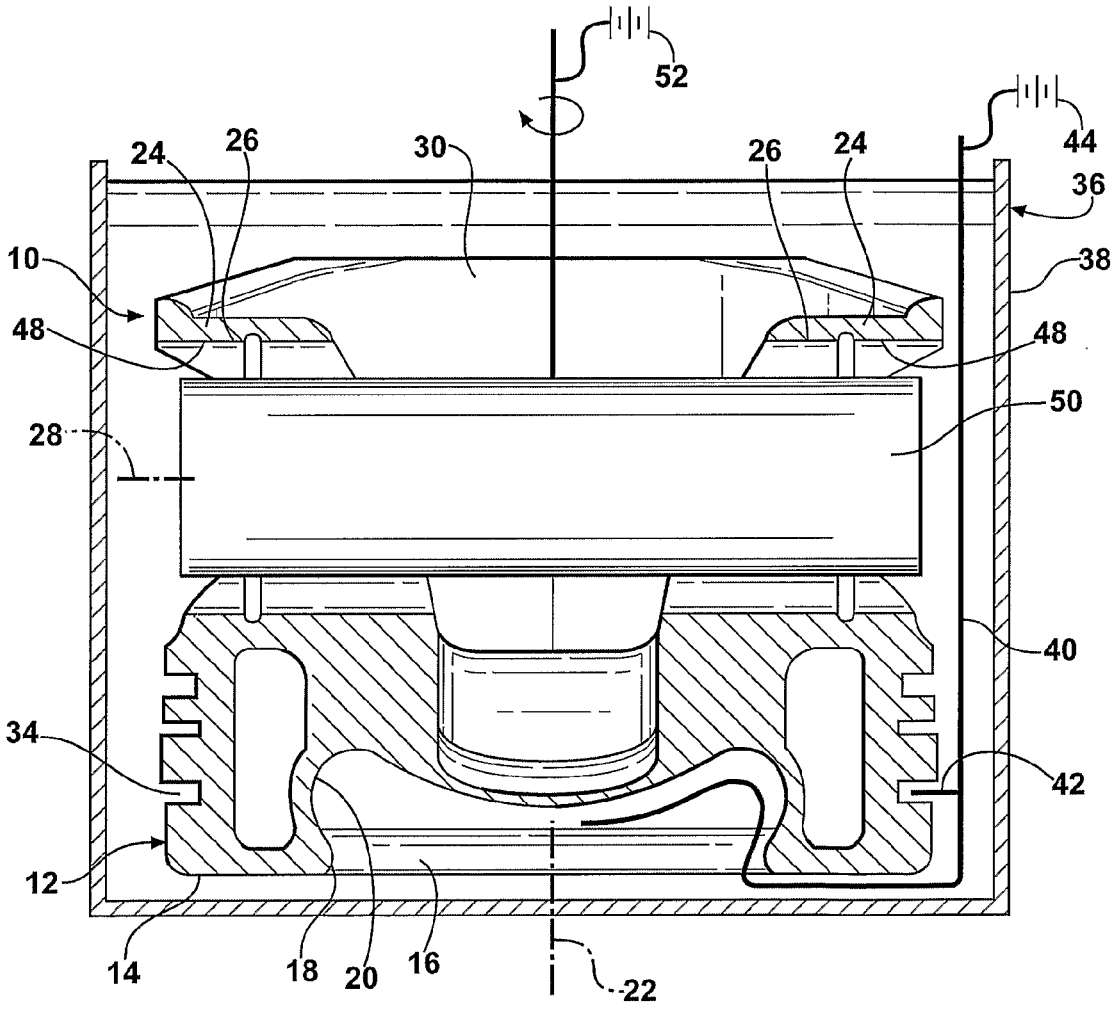
FIG. 3 is a view similar to FIG. 2 rotated 90 degrees about a central axis of the article.

Turning now to the drawings, in which, by way of example and without limitation, FIGS. 1-3 show a piston article 10, referred to hereafter as piston, as the article to be plated. The piston 10 includes a piston head 12 having an upper surface 14 extending substantially perpendicular to the central axis 22 in which a combustion bowl 16 is formed. The combustion bowl 16 may have an edge or lip 18 and an undercut region 20 extending radially outwardly from the lip 18. The piston 10 has a central longitudinal axis 22 which various outer surfaces of the piston extend at least partially symmetrically about, and also includes a pair of laterally spaced pin bosses 24 in which aligned pin bores 26 are formed having a common pin bore axis 28. The pin bore axis 28 extends transversely to the central axis 22, and may be perpendicular to the central axis 22. The piston 10 may further include a pair of opposed piston skirt portions 30 that are formed as one piece with the pin bosses 24 having an outer surface 32. The piston head 12 is formed with a plurality of ring grooves, including an upper ring groove 34 that is closest to the upper surface 14 of the piston article 10.

FIGS. 2 and 3 illustrate the piston 10 in conjunction with a plating apparatus 36. The apparatus 36 preferably includes a plating bath 38 of a selective plating solution (such as, for example, one which will produce a chromium-based coating) in which the piston 10 may be immersed. The apparatus 36 includes a first shaped anode 40 that may be in the form of a wire or other suitable material that can serve as an anode. The anode 40 is arranged along the outside of the piston 10 and has an area less than the total area of the outer surface of the piston 10. The anode 40 is formed to have a shape corresponding to the general shape of the outer surface of the piston in relation to the longitudinal cross section of the piston presented to the anode 40 for the surfaces that are to be plated. As such, even over areas having a geometrically discontinuous shape in axial cross section, such as a surface transforming from a linear surface to a nonlinear and/or curvilinear surface, the anode 40 is able to be conformed to follow the contour of the surface. This is particularly important in being able to apply a uniform coating across the various ring grooves, as well as the undercut region 20.

For example, in connection with the example of the piston 10 shown in FIGS. 1-3, the shaped anode 40 is configured relative to the shape of the piston 10 in order to develop a plating on the outer surface 32 of the skirt portions 30, the upper ring groove 34 and preferably the entire surface of the combustion bowl 16. For this purpose, the shaped anode 40 extends at least partially in the longitudinal direction generally parallel to the central axis 22 and along the outer surface of the piston 10 adjacent the outer surface 32 of the skirt portions 30, along the head of the piston 12. The anode 40 is represented as having a portion 42 extending into the upper ring groove 34 generally perpendicular to the central axis 22, and also has a portion that wraps around the upper surface 14 of the piston 10 and then down into the combustion bowl 16. The portion of the anode 40 in the combustion bowl follows the contour of the undercut region 20 where it may terminate at the central longitudinal axis 22. As such, the undercut region 20 is able to be plated with a uniform thickness of coating material, as desired. Desirably, the distance in which the anode 40 is spaced from the adjacent surfaces can be controlled with a high degree of precision. As such, it will be appreciated that if the piston article 10 were rotated relative to the anode 40 (or vice versa) that the relative movement would cause the entire outer surface of the regions of the piston 10 that are desired to be coated to be exposed to the shaped anode. In other words, with each revolution, the outer surfaces would pass by the fixed shaped anode 40.

In the plating process, the shaped anode 40 is coupled to a corresponding electrical power source, such as rectifier 44 and the piston 10 is electrically coupled to make it a cathode in relation to the anode 40. The piston 10, immersed in the plating bath 38 along with the shaped anode 40, is rotated relative to the shaped anode 40 to develop a controlled thickness of plating 46 on the targeted areas of the piston 10 as mentioned. Of course, other areas may be coated as well, but the shaped anode makes certain that these targeted areas are carefully controlled.

It may be further desirable to coat an inner diameter surface 48 of the pin bores 26 with the plating material from the bath 38. This can be achieved at the same time that the outer surface is coated by positioning another anode, referred to hereafter as a pin bore anode 50, within the pin bore 26 and supporting the pin bore anode 50 in relative fixed relation to the piston 10, while enabling the pin bore anode 50 to rotate concurrently with the piston 10 about the longitudinal central axis 22, and thus, relative to the shaped anode 40 during the plating process. The pin bore anode 50 is coupled to an associated rectifier 52 which results in deposition of the plating material to the pin bore surface 48. Coupling the pin bore anode 50 to its own rectifier 52 separate from the other rectifier 44 enables independent control of the pin bore anode 50 and the corresponding plating of the pin bore surface 48 from that of the shaped anode 40 and the corresponding plating of the other surfaces, including the upper surface 14, the combustion bowl 16, the skirt portions 30, one or more of the ring grooves, if desired.

Accordingly, one aspect of this invention provides the use of anodes which are conformable to varying geometric shapes of surfaces being plated in a plating process, such as a plating process used to coat a heavy duty (HD) steel piston. A wire, such as shown at 40, or other preformed anode member conforming to the approximate shape of surfaces being plated on the piston (skirt area 30 to ring area above the skirt area to top bowl area 14) is utilized to allow deposition of the coating to the areas of interest. This is powered by the plating electrical power source, such as the rectifier 44. The entire piston assembly is rotated within the plating bath 38 such that it revolves past the conformable anode 40 resulting in deposition of the coating over the intended areas. Additionally, the second anode 50 is utilized, with the common cathode connection being the same steel piston 10, whereby this second conformable anode 50 is placed within the pin bores 26 resulting in deposition of the coating on the ID) surface 48 of the pin bores 26. This is powered by the rectifier 52 which, as mentioned, is separate from the rectifier 44.

The use of conformable anodes 40, 50 for plating surfaces of the piston 10 allows the deposition of the coating in those areas where the coating is desired at the desired thicknesses. Spinning the piston 10 allows for uniform deposition around the entire circumference of the piston 10. The use of two separate rectifiers 44, 52 and anodes 40, 50 (with a common cathode designated here as the piston 10) allows for deposition of the coating into areas separate from one another that could not be coated in a single rectifier/anode configuration and allows the desired thicknesses of the plating material to be applied where needed.

The piston 10 will be fitted into a holder or otherwise supported by a member that makes the common cathode connection to the piston 10 as well as to serve as the mechanism for rotating the piston 10 about its central axis 22 so that it can be rotated past the conformable anode 40 that results in deposition of the coating on the piston skirt 30, ring groove area and the upper surface 14, including the combustion bowl

16. The pin bores 26 are plated by means of the cylindrical anode 50 placed within the pin bore area, which as described, is powered by the second rectifier 52. This allows for application of the appropriate plating density and thickness for each of the two separate regions being plated. As such, in a single plating process, the piston areas plated by the separate anodes 40, 50 can have differing plating densities and thicknesses.

Obviously, in light of the above teachings, many modifications and variations of the present invention are possible. It is, therefore, to be understood that within the scope of the appended claims, the invention may be practiced otherwise than as specifically described.

What is claimed is:

1. An apparatus for plating a surface of a piston acting as a cathode, the surface extending at least in part symmetrically about a central axis of the piston and including a portion having a geometrically discontinuous shape in axial cross section, comprising:

a plating bath having a plating material therein;

an electrical power source;

at least one anode in electrical communication with said power source, said at least one anode having a shape substantially conforming to the geometrically discontinuous shape of the portion of the piston; and another anode for plating a portion of the piston separate from the portion being plated by the first anode, wherein said at least one anode remains stationary relative to said plating bath and said another anode is rotatably supported for movement relative to the central axis of the piston.

2. The apparatus of claim 1 wherein said at least one anode is shaped and arranged to plate a combustion bowl of the piston and said another anode is shaped and arranged to plate a pair of pin bores of the piston simultaneously.

3. The apparatus of claim 1 wherein said at least one anode extends in part generally parallel to the central axis and said another anode extends generally perpendicular to the central axis.

4. The apparatus of claim 3 wherein at least a portion of said at least one anode extends generally perpendicular to said axis.

5. The apparatus of claim 1 wherein said at least one anode is a wire.

6. The apparatus of claim 1 further comprising another power source in electrical communication with said another anode separate from said at least one anode.

* * * * *